United States Patent [19]

Kebbell et al.

[11] Patent Number: 4,906,513

[45] Date of Patent: Mar. 6, 1990

[54] NONWOVEN WIPER LAMINATE

[75] Inventors: Michael J. Kebbell; Hugo P. Watts, both of Maidstone, United Kingdom

[73] Assignee: Kimberly-Clark Corporation, Neenah, Wis.

[21] Appl. No.: 252,950

[22] Filed: Oct. 3, 1988

[51] Int. Cl.[4] ..... B32B 15/08; B32B 15/12; B32B 15/26; D04H 5/06

[52] U.S. Cl. ..... 428/198; 15/209 R; 428/283; 428/286; 428/903

[58] Field of Search ..... 15/209 R; 428/698, 283, 428/286

[56] References Cited

U.S. PATENT DOCUMENTS

| | | | |
|---|---|---|---|
| 3,276,944 | 10/1966 | Levy . | |
| 3,338,992 | 8/1967 | Kinney | 264/24 |
| 3,341,394 | 9/1967 | Kinney . | |
| 3,502,538 | 6/1968 | Petersen . | |
| 3,502,763 | 3/1968 | Hartmann | 264/210 |
| 3,509,009 | 4/1968 | Hartmann . | |
| 3,542,615 | 6/1968 | Dobo et al. | 156/181 |
| 3,795,571 | 3/1974 | Prentice . | |
| 3,811,957 | 5/1976 | Buntin | 136/146 |
| 3,978,185 | 8/1976 | Buntin et al. | 264/93 |
| 4,041,203 | 8/1977 | Brock et al. | 428/157 |
| 4,100,324 | 7/1978 | Anderson | 428/288 |
| 4,196,245 | 4/1980 | Kitson et al. | 428/198 |
| 4,298,649 | 11/1981 | Meitner | 428/198 |
| 4,307,143 | 12/1981 | Meitner | 252/91 |
| 4,328,279 | 5/1982 | Meitner | 428/289 |
| 4,426,417 | 1/1984 | Meitner et al. | 428/195 |
| 4,436,780 | 3/1984 | Hotchkiss et al. | 428/198 |
| 4,753,843 | 6/1988 | Cook et al. | 428/286 |
| 4,778,460 | 10/1988 | Braun et al. | 428/286 |
| 4,784,892 | 11/1988 | Storeg et al. | 428/286 |
| 4,797,318 | 1/1989 | Brooker et al. | 428/286 |
| 4,810,571 | 3/1989 | Guthrie | 428/290 |

FOREIGN PATENT DOCUMENTS

| | | | |
|---|---|---|---|
| 803714 | 1/1969 | Canada | 28/5 |
| 0205242 | 12/1986 | European Pat. Off. | 86/51 |

OTHER PUBLICATIONS

"Manufacture of Superfine Organic Fibers" V. A. Wente, E. L. Boone, and C. D. Fluharty, Naval Research Lab. Report No. 4364, May 25, 1954, U.S. Dept. of Commerce.

*Primary Examiner*—James C. Cannon
*Attorney, Agent, or Firm*—William D. Herrick

[57] ABSTRACT

Nonwoven wiper having improved absorbency characteristics and streak-free wiping properties having a laminate construction including a relatively high basis weight middle layer of meltblown thermoplastic microfibers with fibers added and, on one side, a lightweight layer of generally continuous filament thermoplastic fibers having a larger average diameter with a microfiber layer on the other side. These wipers are strong, fabric-like, and are useful for a wide variety of applications including industrial uses, food services, as well as many others. The continuous filament layers provide strength and low lint properties while the combination exhibits improved wiping characteristics. The laminate is preferably bonded by application of heat and pressure and the individual compounents are preferably treated with a surfactant. The preferred combination of a layer of meltblown polypropylene microfibers with fibers added having on one side a spunbonded polypropylene filament layer and on the other a microfiber layer is particularly effective as an all-purpose wiper.

8 Claims, 1 Drawing Sheet

NONWOVEN WIPER LAMINATE

FIELD OF THE INVENTION

This invention relates to disposable wiper products useful for a wide variety of industrial and consumer applications including those in the automotive, food services, and electrical industries as well as for general purpose household wiping. Such wipers must be low-cost and yet provide the strength, absorbency, cloth-like characteristics and other properties desirable for such wiping applications. Nonwoven fabrics, in general, have received wide acceptance as nonwoven disposable wipers both for specific applications and general purpose wiping. For many such applications, nonwoven wipers can out-perform traditional cloth and paper wiping products. However, for some applications, it is desired to even further improve certain nonwoven wiper properties such as resistance to linting and streaking, and it is generally desirable to increase wiper absorbency and strength.

BACKGROUND OF THE INVENTION

U.S. Pat. No. 4,307,143 to Meitner issued Dec. 22, 1981 describes meltblown microfiber wipers treated with a surfactant and embossed. Such wipers are demonstrated to have improved absorbency and wiping properties when compared with traditional wiper materials. U.S. Pat. No. 4,298,649 to Meitner dated Nov. 3, 1981 describes a multi-component nonwoven wiper having a layer of meltblown microfibers combined with a split film or fibrillated foam layer. This wiper exhibits low metal chip pick-up characteristics of particular interest in automotive finishing applications. This property is obtained without significant deterioration in wiping properties. U.S. Pat. No. 4,328,279 to Meitner and Englebert dated May 4, 1982 relates to a meltblown nonwoven wiper treated with certain surfactants to result in low sodium content of particular interest in electronics industry wiping applications. U.S. Pat. No. 4,041,203 to Brock and Meitner dated Aug. 9, 1977 relates to nonwoven fabrics and sterile wrapper materials made by combining layers of meltblown thermoplastic fibers with one or more continuous thermoplastic filament layers. The disclosure recognizes that such materials can be treated for absorbency and used in wiper applications. U.S. Pat. No. 4,196,245 to Kitson, Gilbert, Jr., and Israel dated Apr. 1, 1980 relates to a composite nonwoven fabric useful in disposable surgical items and which can comprise one or more meltblown layers loosely bonded to one or more spunbonded layers.

The preparation of polyolefin microfiber webs is known and described, for example, in Wendt, *Industrial and Engineering Chemistry,* Vol. 48, No. 8 (1956), pp. 1342 through 1346, as well as in U.S. Pat. Nos. 3,978,185 to Buntin, et al., issued Aug. 31, 1976; 3,795,571 to Prentice, issued Mar. 5, 1974, and 3,811,957 to Buntin issued May 21, 1974. The Buntin, et al. patent further discloses that mats of meltblown polyolefins are useful in wiping cloths and hydrocarbon absorption materials. Composite materials including fibers and/or particulates incorporated in a meltblown fiber matrix are described in U.S. Pat. No. 4,100,324 to Anderson, Sokolowski, and Ostermeier issued July 11, 1978.

Production of substantially continuous filaments is also known, and illustrative techniques are set forth in U.S. Pat. Nos. Kinney 3,338,992 and 3,341,394, Levy 3,276,944, Peterson 3,502,538, Hartmann 3,502,763 and 3,509,009, Dobo 3,542,615 and Harmon Canadian Pat. No. 803,714. Reference may also be had to the above-identified Brock and Meitner U.S. Pat. No. 4,041,203 for methods of producing combinations of meltblown thermoplastic fibers and continuous filament thermoplastic fibers. Commonly assigned U.S. Pat. No. 4,340,563 to Appel and Morman dated July 20, 1982, describes an alternative method for producing continuous filament thermoplastic webs.

Wipers made from a matrix of meltblown fibers having incorporated therein a mixture of staple fibers including synthetic and cotton fibers are described in U.S. Pat. No. 4,426,417 to Meitner and Hotchkiss dated Jan. 17, 1984. Laminate wiper materials including a meltblown middle layer with or without other fibers mixed therein between spunbonded outer layers are described in U.S. Pat. No. 4,436,780 to Hotchkiss, Notheis, and Englebert dated Mar. 13, 1984. A laminate material useful for wiping applications and including a layer of meltblown fibers having other fibers or particles mixed therein combined with at least one meltblown layer is described in published European Application No. 0205242 dated to Storey and Maddern published Dec. 17, 1986.

SUMMARY OF THE INVENTION

The present invention relates to an improved nonwoven wiper having low lint and reduced streaking characteristics while also demonstrating improved absorbancy. The wiper is a combination of a relatively high basis weight center layer of meltblown thermoplastic microfibers having other fibers or particles mixed therein. On one side thereof there is a relatively lightweight layer of continuous filament thermoplastic fibers of larger diameter. On the other side there is a lightweight meltblown microfiber layer. All components are treated with a surfactant for wettability, and the combination is preferably bonded by a patterned application of heat and pressure. The resulting wiper is fabric-like, conformable, and useful for many industrial applications as well as general purpose wiping. Preferred thermoplastic materials are polyolefins, and the individual components are preferably made from the same polymer or polymers having similar melt temperatures. Preferred surfactants include ionic and nonionic surfactants such as dioctylester of sodium sulfosuccinic acid (Aerosol TO).

DESCRIPTION OF THE PREFERRED EMBODIMENTS

Figure 1:
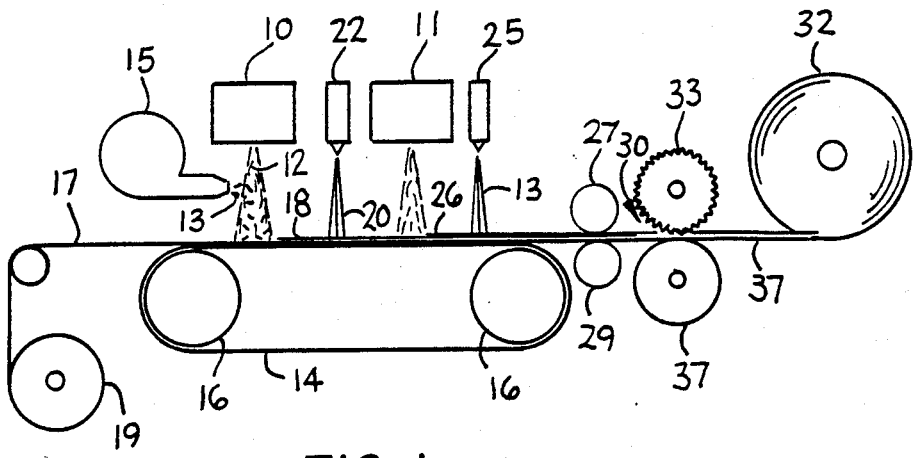
FIG. 1 schematically illustrates a process for making the wipes of the present invention.

While the invention will be described in connection with preferred embodiments, it will be understood that it is not intended to limit the invention to those embodiments. On the contrary, it is intended to cover all alternatives, modifications, and equivalents as may be included within the spirit and scope of the invention as defined by the appended claims.

Microfiber webs produced for the wipers of the present invention are characterized by an average fiber diameter in the range of up to about 10 microns and are preferably manufactured in accordance with the process described in U.S. Pat. No. 3,978,185 to Buntin, et al., dated Aug. 31, 1976 which is incorporated herein by reference in its entirety and to which reference may be made for details of the meltblown process. Although the example below was carried out with polypropylene, it will be understood that the invention is not limited thereto and that other thermoplastic polymers capable of meltblowing, including polyethylene, polyesters, and polyamides, may be utilized as well. To produce the meltblown web with fibers or particles mixed therein the method and apparatus described in U.S. Pat. No. 4,100,324 to Anderson, Sokolowski and Ostermeier dated July 11, 1978 may be used. For best results, in accordance with this invention, the webs contain at least about 30% by weight microfibers, preferably 50% by weight microfibers, and the preferred additional fibers comprise wood pulp.

The continuous filament webs may be produced as described in the above-identified patents relating to spunbonded processes. Suitable polymers include the same ones useful for the meltblowing process. Preferably, polymers used for the component layers are the same.

In a preferred embodiment, the spunbonded layers are individually pattern bonded prior to combining with the meltblown layer. For example, a pattern as illustrated in U.S. Design Pat. No. 239,566 to Vogt dated Apr. 13, 1976 having about 153 bonds/in.$^2$ and about 25% bonded surface area may be employed as may be a pattern illustrated in U.S. Design Pat. No. 264,512 to Rogers dated May 18, 1982. Such prebonding permits the use of lower overall bonded area when bonding the laminate.

In accordance with the invention, the meltblown web (including added fibers) will have a relatively high basis weight in the range of from about 17 to 170 gsm, preferably in the range of from about 30 to 60 gsm. In contrast, the individual continuous filament layer will have a relatively low basis weight in the range of from about 7 gsm to 34 gsm and preferably 10 gsm to 20 gsm. The exposed meltblown web will have a basis weight generally in the range of from about 5 gsm to 30 gsm with a preferred range of from 10 gsm to 20 gsm.

Any of a wide variety of surfactants, ionic and nonionic may be employed with the individual component layers. These include, for example, dioctylester of sodium sulfosuccinic acid (Aerosol TO), isooctyl phenylpolyethoxy ethanol (Triton X-100 and X0102) and others. When the continuous filament layer already contains a surfactant, preferably the surfactant is added only to the meltblown and meltblown with added fiber layers and in an amount of about 0.1 to 1.0% each layer by weight, preferably about 0.2 to 0.6%. Alternatively, the laminate may be treated as a whole by dipping or the like.

Combining of the component webs is preferably accomplished by patterned application of heat and pressure. The particular bonding conditions will depend on the specific material, but in general, it is preferred to use a bond pattern employing about 10 to 250 bonds/inch$^2$ (more preferably 20 to 110 bonds/inch$^2$) for coverage of about 5 to 25% (more preferably 10–15%) of the surface area. The bonding temperature, for polypropylene, for example, is preferably in the range of from about 180° F. to 330° F., with a pressure preferably in the range of from about 150 pli to about 400 pli. Reference may be had to U.S. Design Pat. No. 239,566 to Vogt dated Apr. 13, 1976 and U.S. Pat. No. 3,855,046 to Hansen and Pennings dated Dec. 17, 1974 for illustrations of bonding patterns. The basis weight of the composite laminate is generally in the range of from about 30 to 150 gsm, preferably about 50 to 105 gsm.

Turning to FIG. 1, a process for forming the wiper material of the invention will be briefly described. Other forming and combining operations that may be utilized will be apparent to those skilled in the art, and it is not intended to limit the invention to the operation specifically set forth.

Figure 2:
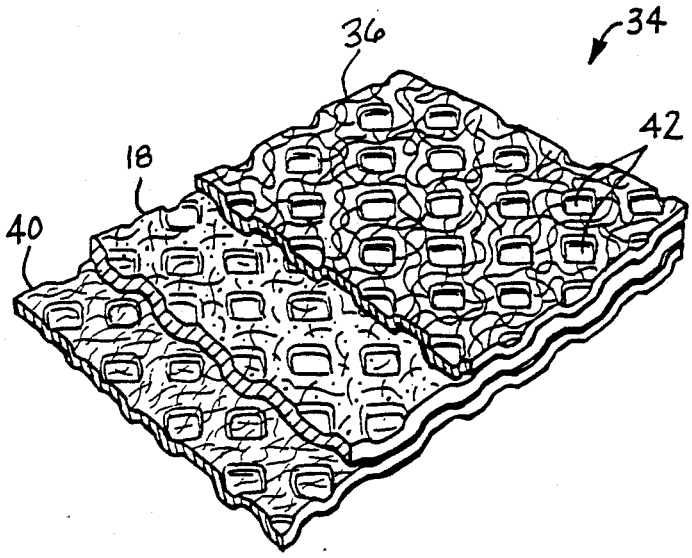
FIG. 2 illustrates the multi-component wiper of the present invention.

As shown, meltblowing die 10 deposits microfibers 12 including other fibers 13 supplied from picker 15 onto spunbond web 17 from parent roll 19 carrier by a moving wire 14 supported by rolls 16, one or more of which may be driven. A lose batt 18 is formed to which is added wetting agent 20 by spray nozzle 22. Meltblown microfiber web 26 is deposited by meltblown die 11 onto the middle layer 18 and a wetting agent 13 added by spray nozzle 25. The combination is compacted by turning rolls 27 and 29 and bonded by heat and pressure at pattern calender nip 30 between patterned roll 33 and anvil roll 35, and laminate 37 is wound into parent roll 32 which may be slit into individual wipers shown, for example, in FIG. 2. Turning to FIG. 2, a three-ply laminate wiper 34 is illustrated including microfiber with fibers added layer 18 between continuous filament layer 36 and microfiber layer 40 with pattern bond areas 42.

The invention will now be described in terms of a specific example.

EXAMPLE

A laminate wiper material was made as illustrated in FIG. 1. A spunbond polypropylene web having a basis weight of 14 gsm and pattern bonded with a diamond pattern of 225 bonds per in$^2$ covering 25% of the surface area generally made in accordance with U.S. Pat. No. 3,855,046 to Hansen and Pennings dated Dec. 17, 1974 was unwound onto a forming wire. A meltblown polypropylene web including 70% wood pulp fibers was formed directly onto the spunbonded web at a basis weight of 45 gsm and rate of 5.4 PIH polymer, generally as described in U.S. Pat. No. 4,100,324 to Anderson, Sokolowski, and Ostermeier dated July 11, 1978. To the meltblown matrix was added 0.6% by weight of a diocytlester of sodium sulfosuccinic acid surfactant (Aerosol OT available from Cyanamid U.K.). Using a second meltblowing die, a polypropylene microfiber web having a basis weight of 15 gsm was deposited onto the meltblown matrix side opposite the spunbonded layer at a rate of 6 PIH polymer. This microfiber layer was treated with the same surfactant added at 0.6% by weight. The combined layers were bonded by passing through a nip between a heated (225°) diamond engraved roll and a heated (212°) plain anvil roll. The pattern was 30 bonds per in$^2$ and covered 12% of the surface area.

Wipers formed from this laminate were tested with the following results:

| | |
|---|---|
| Lint | 16 mg/m$^2$ |
| Water Absorbency Rate: | 0.7 sec. |
| Water Absorbency Capacity: | 710% |
| Oil Absorbency Rate: | 15 sec. |
| Oil Absorbency Capacity: | 670% |
| Grab Tensile: | MD 3392 g peak |
| | CD 3458 g peak |

-continued

| | |
|---|---|
| Bulk: | 1.15 mm |

Lint was determined by weight released upon shaking. A piece of masking tape about 76 mm long and a sample of the material to be tested (about 25 cm by 40 cm) were weighed. Grasping opposite edges between thumb and two fingers of each hand, the sample was oscillated vertically up and down vigorously over a black glass plate 559 mm×457 mm 50 times with opposite motion of each hand. The sample was turned and the procedure repeated grasping the opposite edges. Any particles released were scraped to the center of the plate using a straight edge scraper. The particles were then collected by lightly wiping with the sticky side of the tape after which the tape was folded upon itself and weighed. The weight of particles was calculated as milligrams per square meter of sample, and an average of five tests reported.

Water absorbency and rate were determined by saturation with distilled water at room temperature. In preparation, a piece of standard felt (The British Paper and Board Industry Federation (per Test RTM29:1980) approximately 15 cm by 30 cm was saturated by immersion for at least 24 hours in a tray (30 cm by 40 cm by 6 cm) half full of distilled water at room temperature. After weighing, a 10 cm by 10 cm sample of test material was gently placed on the water surface over the submerged felt, and the time recorded. The sample was observed until it had completely changed color, and that time recorded with the time differential reported as the water absorption rate. The sample was then gently pressed, under the water surface with forceps and located on the top half of the felt. After being submerged for at least a minute the felt and sample were removed by holding the top edge of the felt and avoiding movement of the sample on the felt. The felt with the sample was suspended above the tray until the sample attained a uniform overall color after which the sample was removed from the felt and reweighed. The percent absorptive capacity was calculated as 100 times the difference in sample weights divided by the original sample weight.

Oil absorbency and rate were determined in the same manner as for water by substituting SAW 20W/50 motor oil (e.g. CASTROL GTX) for water.

Grab tensile was determined by measuring peak load using an Instron tester in accordance with Method 5100 Federal Test Methods Standard No. 191A.

Bulk was determined by the use of a Starrett dial guage Model 25-881, 0–100 dial units with 0.01 mm graduation having a full span of 25 cm. A 100 mm×100 mm Lucite block was selected with thickness adjusted to give a total force exerted on the sample by the block and the spring of 225 g (125 g). Each sample was 100 mm by 100 mm and free of creases or wrinkles. The platen was raised and a sample centered on the bed plate as far as possible under the platen. The platen was released onto the sample, and the bulk read 10 to 20 seconds after release. The results were reported to the nearest 0.01 mm, and an average of tests on at least three samples reported.

As shown, the wiper of the present invention exhibits improved characteristics for wipers for oil and water, particularly in the features of absorbency and streak-free wiping. These results are particularly advantageous in food service wipes applications, for example, where leaving a streak-free stainless steel surface is often very important. Furthermore, the low lint characteristics are important for electronics and other applications where a dust-free environment is considered necessary. Other applications for high quality wiper products will be apparent such as, for example, in health care as surgeons' hand towels and the like.

While it is not desired to limit the invention to any theory, it is believed that the lightweight continuous filament outside webs provide strength and wicking action which rapidly draws liquid through to the highly absorbent microfiber and fiber mixture layer. This microfiber layer then aggressively holds the liquid within its interstices and resists streaking. The opposite microfiber layer provides streak-free, clean wiping.

Thus it is apparent that there has been provided, in accordance with the invention, a wipe material that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

We claim:

1. Wiper comprising a laminate including, (a) a central, high absorbency layer comprising a matrix of thermoplastic microfibers having mixed therein other fibers or particles, (b) on one side of said central layer, a relatively lightweight layer of continuous filaments of larger diameter, and (c) on the side of said central layer opposite from said continuous filaments layer, a relatively lightweight thermoplastic microfiber layer, said laminate being pattern bonded and containing a surfactant.

2. Wiper of claim 1 wherein the continuous filament layer comprises a spunbond polypropylene web having a basis weight in the range of from about 7 to 34 gsm.

3. Wiper of claims 1 or 2 wherein said central layer comprises a matrix of polypropylene microfibers having distributed therein up to 70% by weight of woodpulp fibers and said central layer having a basis weight in the range of from about 17 to 170 gsm.

4. Wiper of claim 3 wherein said thermoplastic microfiber surface layer comprises polypropylene microfibers and has a basis weight in the range of from about 5 to 30 gsm.

5. Wiper of claim 4 wherein the surfactant is selected from the group consisting of dioctyl esters of sodium sulfosuccinic acids and isocetyl phenylpolyethoxy etanols.

6. Wiper of claim 5 wherein the surfactant is included in an amount of between about 0.1 to 1.0% by weight in each of the exposed microfiber and central layers.

7. Wiper of claim 6 wherein the laminate is bonded in a pattern of about 10 to 250 bonds/in$^2$ and occupying about 5 to 25% of the surface area.

8. Wiper of claim 7 having a total basis weight in the range of from about 30 to 150 gsm.

* * * * *

UNITED STATES PATENT AND TRADEMARK OFFICE

CERTIFICATE OF CORRECTION

PATENT NO. : 4,906,513

DATED : March 6, 1990

INVENTOR(S) : Michael J. Kebbell, et al

It is certified that error appears in the above-identified patent and that said Letters Patent is hereby corrected as shown below:

In the Abstract, line 15 "and the individual compounents" should read --and the individual components--.

Column 2, line 49, "TO" should read --OT--;

Column 3, line 49, "TO" should read --OT--.

Signed and Sealed this

Seventh Day of July, 1992

*Attest:*

DOUGLAS B. COMER

*Attesting Officer*

*Acting Commissioner of Patents and Trademarks*